US009330592B2

(12) United States Patent
Xie

(10) Patent No.: US 9,330,592 B2
(45) Date of Patent: May 3, 2016

(54) PIXEL STRUCTURE AND DISPLAY DEVICE COMPRISING THE SAME

(71) Applicant: BOE TECHNOLOGY GROUP CO., LTD., Beijing (CN)

(72) Inventor: Hongjun Xie, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 265 days.

(21) Appl. No.: 14/141,392

(22) Filed: Dec. 26, 2013

(65) Prior Publication Data

US 2014/0210876 A1 Jul. 31, 2014

(30) Foreign Application Priority Data

Jan. 25, 2013 (CN) ..... 2013 1 0030336

(51) Int. Cl.
*G09G 3/20* (2006.01)

(52) U.S. Cl.
CPC ..... *G09G 3/2092* (2013.01)

(58) Field of Classification Search
CPC ..... G09G 2300/0492; G09G 3/2092
See application file for complete search history.

(56) References Cited

U.S. PATENT DOCUMENTS 5,856,818 A * 1/1999 Oh ..... G09G 3/3685 345/213
6,714,212 B1 3/2004 Tsuboyama et al.
2007/0146274 A1 6/2007 Miyazawa
2013/0321251 A1* 12/2013 Kang ..... G09G 3/36 345/87
2013/0321483 A1* 12/2013 You ..... G09G 5/10 345/690

FOREIGN PATENT DOCUMENTS

CN 102385847 A 3/2012
CN 203277386 U 11/2013

OTHER PUBLICATIONS

Office Action for corresponding Chinese Patent Application No. 201310030336.8, 6 pages, (Dec. 31, 2014).

* cited by examiner

*Primary Examiner* — Carolyn R Edwards
(74) *Attorney, Agent, or Firm* — Blakely, Sokoloff, Taylor & Zafman LLP

(57) ABSTRACT

The present invention discloses a display device comprising the structure. The pixel structure comprises multiple pixel units arranged in a matrix form, and multiple gate lines and data lines for providing drive to the multiple pixel units, wherein the multiple pixel units are scanned progressively in unit of L rows; the L rows of pixel units being simultaneously scanned among the plurality of pixel units are configured as a pixel block; and at least two adjacent rows of pixel units in the L rows of pixel units being used for displaying different images, wherein L≥3. By adopting the pixel structure, the problems of undercharge of a storing capacitor Cs and RC delay of the data lines are alleviated, thus the display uniformity and the display quality of the display device is ensured. The pixel structure is particularly suitable to a large-size ultra-high-resolution display device.

16 Claims, 8 Drawing Sheets

PIXEL STRUCTURE AND DISPLAY DEVICE COMPRISING THE SAME

FIELD OF THE INVENTION

The present invention belongs to the field of display technology, and in particular relates to a pixel structure and a display device comprising the structure.

BACKGROUND OF THE INVENTION

Generally, a flat panel display device comprises a plurality of pixel units arranged in a matrix form. Pixel units are divided into two categories according to drive modes: passive matrix (referred to as PM) drive-mode pixel units and active matrix (referred to as AM) drive-mode pixel units. The AM drive-mode pixel structures have been widely applied due to obvious advantages in aspects of viewing angle, color reproduction, power consumption, response time and the like.

In a display device such as a thin film transistor liquid crystal display or an organic light-emitting diode (OLED) display, a display panel has a plurality of pixel units, the number of which is up to millions or more, and each of which comprises a thin film transistor (referred to as TFT), a storing capacitor (referred to as Cs below), a light-emitting device connected with the TFT, and the like. From the perspective of driving mechanism, an AM drive-mode pixel structure is a matrix-addressed pixel structure, which comprises gate lines (i.e. scan lines) providing row-strobe scanning signals and data lines providing column-strobe data signals to the pixel unit. The scanning signals and the data signals are acting on the TFT simultaneously, and the current of the light-emitting device connected therewith is controlled through controlling the on or off of the TFT, so that the light-emitting device can emit light within the controllable time period of one frame in order to display an image.

Taking an OLED display device as an example, as shown in FIG. 1, an 2T1C pixel circuit structure generally used in the OLED in the prior art comprises switch tubes T1 and T2 and a storing capacitor Cs. In the general OLED pixel structure, as shown in FIG. 2, each column of sub-pixel units correspond to one data line 2, and each row of sub-pixel units correspond to one scan line 3 (the scan lines in FIG. 2 are marked by dashed lines for the sake of distinguishing them from the data lines, however, in actual circuitry, the scan lines and the data lines are similar physical circuit wires; the scan lines in the following drawings are similarly marked). In a progressive scanning mode, the scan lines are enabled row by row, and the pixels are refreshed column by column. When a scan line is selected, a row strobe signal Vsel turns on T1, a data voltage Vdata charges Cs through the T1, and the voltage of Cs controls the drain current of T2. As the gate potential of the T2 gradually increasing, the T2 is turned on and stably operates in a saturation region. On the other hand, when the scan line is not selected, the T1 is cut off, charges stored on the Cs continues maintaining the gate voltage of T2, and T2 remains in a conducting state, so that the OLED is under constant-current control in a frame period.

An ultra-high-resolution display panel is featured by a large number of pixels, a large quantity of data and a high drive frequency. If the existing pixel structure connecting mode is applied to an ultra-high-resolution display device, the shortcoming of the time limitation for charging each line becomes salient; and meanwhile, the problems of a long drive wire, serious RC delay and the like also arise. Moreover, the high drive frequency will also result in an undercharge of pixel units, thereby adversely affecting display uniformity;

and the long drive wire results in over-high impedance of wire in a single drive mode, thus adversely affecting the integrity of a drive signal. For example, if the total number of rows is Th and the frame refresh rate is 60 Hz in the display panel, then the charging time of each row is about 16.67 ms/Th. If the resolution is 1920*1080 and Th is 1125 in a full high definition (referred to as FHD) display panel, then the charging time of each row is about 14 μs; and if the resolution is 3840*2160 and the refresh rate is 60 Hz, then the charging time of each row is about 6 μs. It can be seen that as the resolution of the display panel increasing, the charging time is shortened greatly, and in addition, due to signal delay resulting from the wire impedance of the data lines, a predetermined charging voltage of Cs can not be reached, ultimately resulting in the shortcomings of poor display uniformity, gradual change of display brightness and the like. In a dual-gate drive mode adopted in a small-size product to increase the scanning frequency, the row charging time is only half of the original charging time, thus such drive mode can not be used in a large-size ultra-high-resolution display device either.

It is thus clear that the traditional pixel structure of the existing flat panel display device can not be applied to the ultra-high-resolution display device, and as the size of the display panel increasing, the problems comprehensively produced by the data lines and the wire impedance thereof would be more obvious, so that the problem of RC delay becomes more salient. In order to solve the above problems existing in the large-size high-resolution display device, a partitioning drive mode is often adopted at present in the technical field of display, that is, the whole display panel is partitioned into a plurality of regions (such as strip-type regions or four-quadrant regions) and to be driven respectively. In the partitioning drive mode, each region is provided with an independent source driver chip and a timing controller (TCON) chip, and utilizes a separate gate driver chip or a common gate driver. In order to adapt to the large size of the display panel, a dual-drive mode or a single-drive mode can be adopted for both the gate and the source, so as to improve the problems of insufficient driving capability and serious RC delay. However, the synchronous requirement for the timing control chip would be very high when adopting the strip-type partitioning drive mode, and difference among partitioned regions may occur during display when adopting the four-quadrant partitioning drive mode. Therefore, it is in dire need of designing a flat panel display device which is capable of not only solving the problem of undercharge of the storing capacitor Cs, but also guaranteeing the display quality.

SUMMARY OF THE INVENTION

In view of the foregoing technical problems to be solved in the prior art, the present invention provides a pixel structure exhibiting excellent display quality and being capable of effectively eliminating or alleviating the problem of undercharge of the storing capacitor Cs, and a display device comprising the structure.

The technical solution used to solve the technical problem of the present invention involves a pixel structure, comprising a plurality of pixel units arranged in a matrix form, and a plurality of gate lines and data lines for providing drive to the plurality of pixel units, wherein the plurality of pixel units are scanned progressively in unit of L rows; the L rows of pixel units being simultaneously scanned among the plurality of pixel units are configured as a pixel block; and at least two adjacent rows of pixel units in the L rows of pixel units are used for displaying different images, wherein L≥3 and L is a positive integer.

Preferably, the plurality of pixel units each comprise a plurality of sub-pixel units having their respective predetermined colors, and each column of the sub-pixel units is provided with L data lines which are connected to the sub-pixel units in a same column in such a manner that one of the L data lines is only connected to one out of the L rows of sub-pixel units, wherein sub-pixel units in odd pixel blocks are connected with the data lines in the sequence order of rows, respectively, and sub-pixel units in even pixel blocks are connected with the data lines in the reverse order of rows, respectively.

Further preferably, the number of gate lines in each pixel block is (L−1), each gate line is connected to at least one of the adjacent rows of sub-pixel units in the same column, and each sub-pixel unit has one and only gate line connected therewith.

Preferably, L=3, wherein a first gate line is arranged between the first and the second rows of the pixel units, and a second gate line is arranged between the second and the third rows of the pixel units; and wherein the first gate line is connected with the first row of sub-pixel units in all columns and the second row of sub-pixel units in odd columns or even columns, and the second gate line is connected with the third row of sub-pixel units in all columns and the second row of sub-pixel units in the even columns or odd columns.

Further preferably, the number of gate lines in each pixel block is L, and each sub-pixel unit has one and only gate line connected therewith.

Further preferably, the row numbers of sub-pixel units in the odd pixel blocks connected with the respective data lines are 3i-2, 3i-1 and 3i; and the row numbers of sub-pixel units in the even pixel blocks connected with the respective data lines are 3i, 3i-1 and 3i-2, wherein i is an arrangement sequence number of pixel blocks from top to bottom.

Preferably, the pixel units receive scanning control signals according to a display sequence of images to be displayed, and image data of images to be displayed corresponding to pixel units in the same pixel block are stored as a group, and scanning signals are sent to pixel units for displaying the corresponding images to be displayed through all the gate lines contained in the corresponding pixel block simultaneously.

Preferably, the gate lines are driven in a dual-drive mode or a single-drive mode, and the data lines are driven in a dual-drive mode or a single-drive mode.

In this case, each of the pixel units comprises sub-pixel units having three or four colors respectively, wherein the three colors are red, green and blue, or the four colors are red, green, blue and white, and the sub-pixel units in each pixel unit are arranged in the same color sequence.

A display device comprises the above pixel structure.

Figure 1:
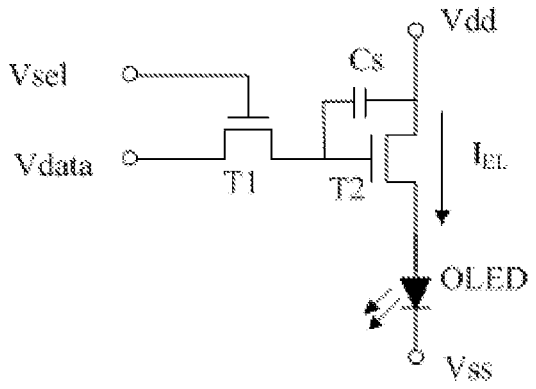
FIG. 1 shows a general pixel circuit structure in the prior art.
Figure 2:
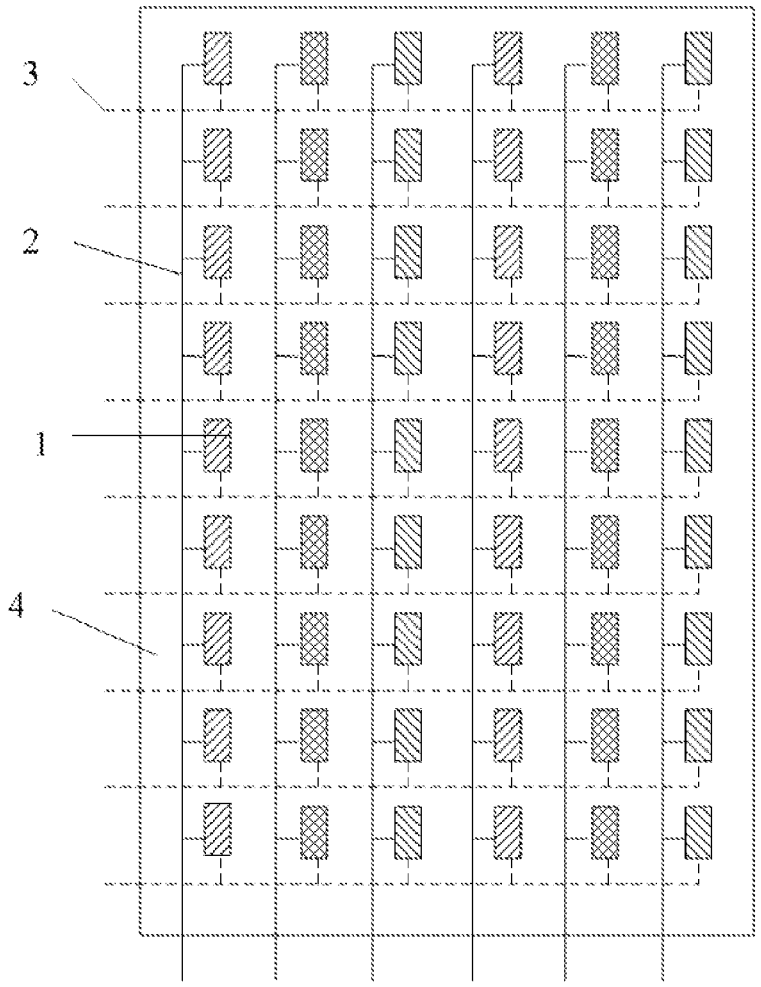
FIG. 2 shows a schematic diagram of a pixel structure in the prior art.

In the drawings: 1—sub-pixel unit; 2—data line; 3—gate line; 4—display area.

DETAILED DESCRIPTION OF THE EMBODIMENTS

To make the person skilled in the art better understand the technical solution of the present invention, a pixel structure and a display device comprising the pixel structure of the present invention are further described in detail below in conjunction with the accompanying drawings and the particular embodiments.

The technical conception of the present invention is, in view of the demand for reducing the row scanning frequency, to design a pixel structure with row scanning frequency relatively lowered, thereby ensuring sufficient charging time for a storing capacitor Cs in each pixel unit; and at the same time to adopt a partitioning design, so that the R and C values of each data line is lowered, thereby shortening the RC delay time, and addressing the problems occurring in large-size high-resolution conditions.

The present invention provides a pixel structure, comprising a plurality of pixel units arranged in a matrix form, and a plurality of gate lines and data lines for providing drive to the pixel units. The pixel units are scanned progressively in unit of L rows through the gate lines. Every L rows of pixel units being simultaneously scanned among the plurality of pixel units are configured as a pixel block. At least two adjacent rows of pixel units in the L rows of pixel units are used for displaying different images, wherein L≥3.

The present invention also provides a display device comprising the pixel structure.

In the pixel structure of the present invention, a plurality of pixel units are arranged in a matrix form, and the pixel units are scanned progressively in unit of L rows simultaneously through the gate lines, and every L lines of pixel units being simultaneously scanned are configured as a pixel block, wherein L≥3. Therefore, compared with the pixel structure in the prior art not adopting the above construction, the pixel structure of the present invention improves the display uniformity of the display device while guaranteeing the charging time of the storing capacitor Cs.

In one embodiment, the plurality of pixel units are arranged in a matrix form of M rows*N columns, and the pixel units each comprise a plurality of sub-pixel units having their respective predetermined colors. The number of the data lines is L*N, and each column of sub-pixel units correspond to L data lines. L data lines corresponding to a column of sub-pixel units are respectively connected to different rows of sub-pixel units in each pixel block. With the configuration, the pixel unit according to the embodiment effectively shortens the RC delay time of the data lines, and improves the display uniformity of the display device.

In the embodiment of the present invention, each pixel block comprises L rows of pixel units. In a preferred embodiment of the present invention, the number of gate lines adopted for L rows of pixel units in a pixel block can be smaller than or equal to L, such that each sub-pixel unit has one and only gate line connected therewith. When the number of gate lines in a pixel block is smaller than rather equal to L, one gate line can be connected to more than one sub-pixel units, thus reducing the number of output channels of a gate driver. In a preferred embodiment, each gate line in a pixel block can be connected to substantially the same number of sub-pixel units. In this way, the loading on each gate line is substantially equivalent. More preferably, sub-pixel units connected by each gate line can be uniformly distributed in the whole pixel structure, thus further improving the display uniformity. For example, the number of gate lines in each pixel block can be (L−1). Each gate line can be connected with at least one of the adjacent row of sub-pixel units in the same column.

During image displaying, pixel units receive scanning control signal according to the display sequence of images to be displayed, and image data of images to be displayed corresponding to pixel units in the same pixel block are stored as a group, and scanning signals are sent to pixel units for displaying the corresponding images to be displayed through all the gate lines contained in the corresponding pixel block simultaneously.

Some preferred embodiments of the present invention are described below in detail with reference to the accompanying drawings. It should be appreciated by the person skilled in the art that the examples shown in the drawings are only some preferred implementing ways of the present invention, and are intended for illustrating instead of limiting the scope of the present invention. The present invention can also be implemented in various other ways.

Embodiment 1

Figure 3:
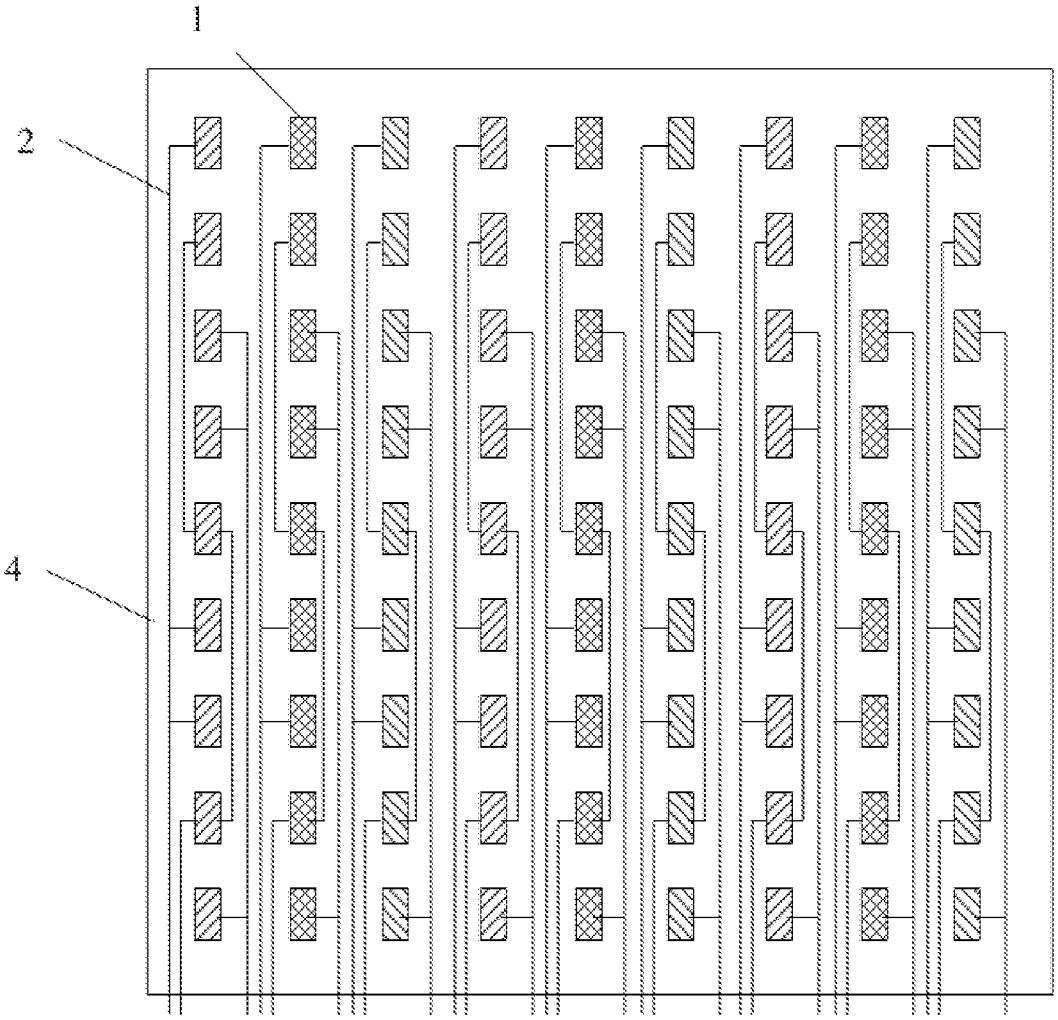
FIG. 3 is a connection schematic diagram of data lines in a pixel structure of embodiment 1 of the present invention.
Figure 4:
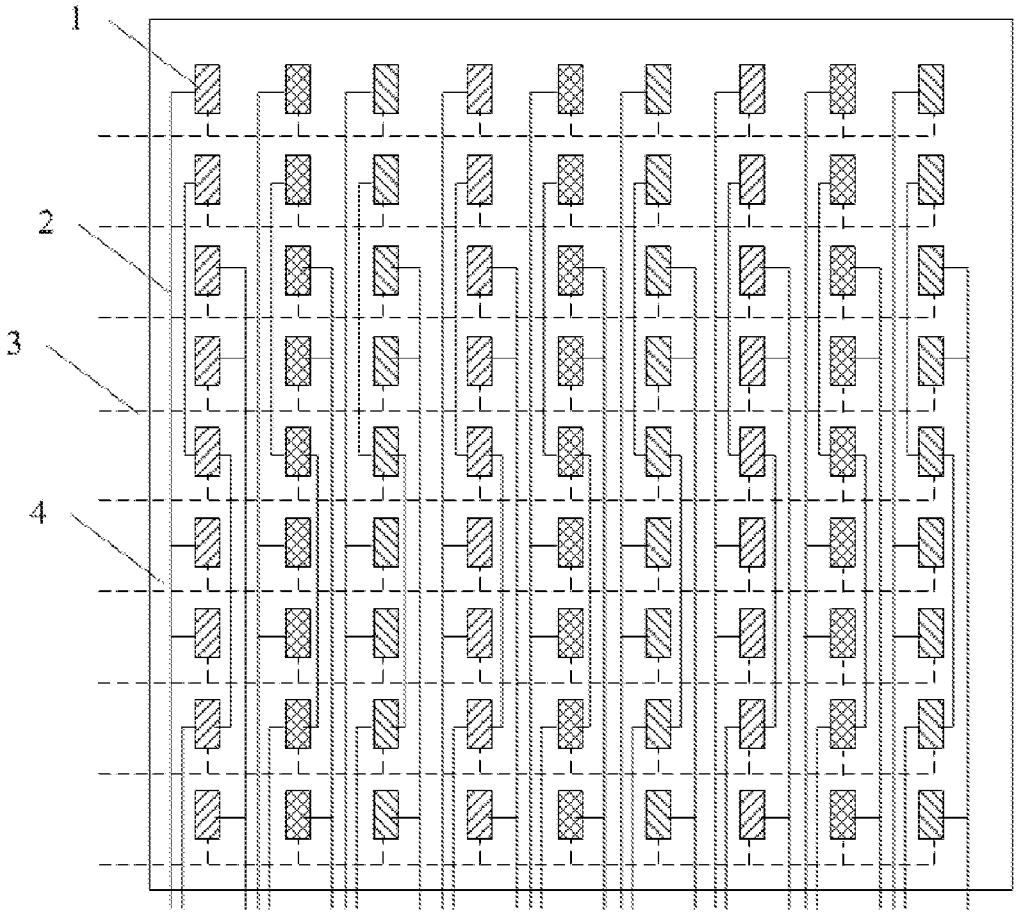
FIG. 4 is a connection schematic diagram of gate lines in the pixel structure of embodiment 1 of the present invention.

FIGS. 3 and 4 show implementation of a preferred embodiment of the present invention. FIG. 3 shows a schematic diagram of an exemplary arrangement of data lines of a pixel structure according to the embodiment. As shown in FIG. 3, L is preferably three, that is, every three adjacent rows of the pixel units are configured as a pixel block, and the same column of sub-pixel units in each of the pixel blocks is provided with three data lines 2, and each data line is respectively connected to different rows of sub-pixel units. A connection schematic diagram of the data lines is as shown in FIG. 3. In a display area 4 of a display panel, each data line is connected in series with a plurality of sub-pixel units successively from the top to the bottom of the display area 4, and is connected with a data driver (i.e. source driver IC) outside the display area. The number of source output channels of the data driver is three times of that in the prior art. FIG. 4 shows an exemplary arrangement of gate lines in each pixel block in the embodiment, wherein each pixel block includes three gate lines 3, that is, a row of pixel units are connected with one gate line.

In the embodiment, the sub-pixel units are connected with the data lines in such a manner that three rows of sub-pixel units in each pixel block are respectively connected to three different data lines. Specifically, each column of sub-pixel units correspond to three data lines, and each of the three data lines is respectively connected to one of every three rows of sub-pixel units in the same column. Moreover, each row of sub-pixel units in an odd pixel block are respectively connected with three data lines in the order of rows, while each row of sub-pixel units in an even pixel block are respectively connected with three data lines in the reverse order of rows. That is, as for each column of sub-pixel units, the serial numbers of data lines connected with respective sub-pixel units in an odd pixel block are consistent with the row arrangement sequence of the sub-pixel units in the pixel block, and the serial numbers of data lines connected with respective sub-pixel units in an even pixel block are reverse to the row arrangement sequence of the sub-pixel units in the pixel block. For example, suppose i is a row arrangement sequence number of a pixel block, then as for the same column of sub-pixel units in an odd pixel block, the row numbers of the sub-pixel units respectively connected with first, second and third data lines are 3i-2, 3i-1 and 3i; and as for the same column of sub-pixel units in an even pixel block, the row numbers of the sub-pixel units respectively connected with the first, second and third data lines are 3i, 3i-1 and 3i-2. Specifically, every three rows in the display area 4 are configured as one pixel block, and a plurality of pixel blocks are numbered from top to bottom, respectively as block 1, block 2, block 3 . . . . The rows of the sub-pixel units in an odd block, such as block 1 or block 3, are respectively connected with the first, second and third data lines in obverse sequence of row numbers; and the rows of the sub-pixel units in an even block, such as block 2 or block 4, are respectively connected with the first, second and third data lines in reverse sequence of row numbers. Thus, as shown in FIG. 3, data lines in the plurality pixel blocks in the same column are connected with the plurality of rows of sub-pixel units in the following sequence: the first data line is connected to sub-pixel units with the row numbers of 1, 6, 7 . . . , the second data line is connected to sub-pixel units with the row numbers of 2, 5, 8 . . . , and the third data line is connected to sub-pixel units with the row numbers of 3, 4, 9 . . . .

Embodiment 2

Figure 5:
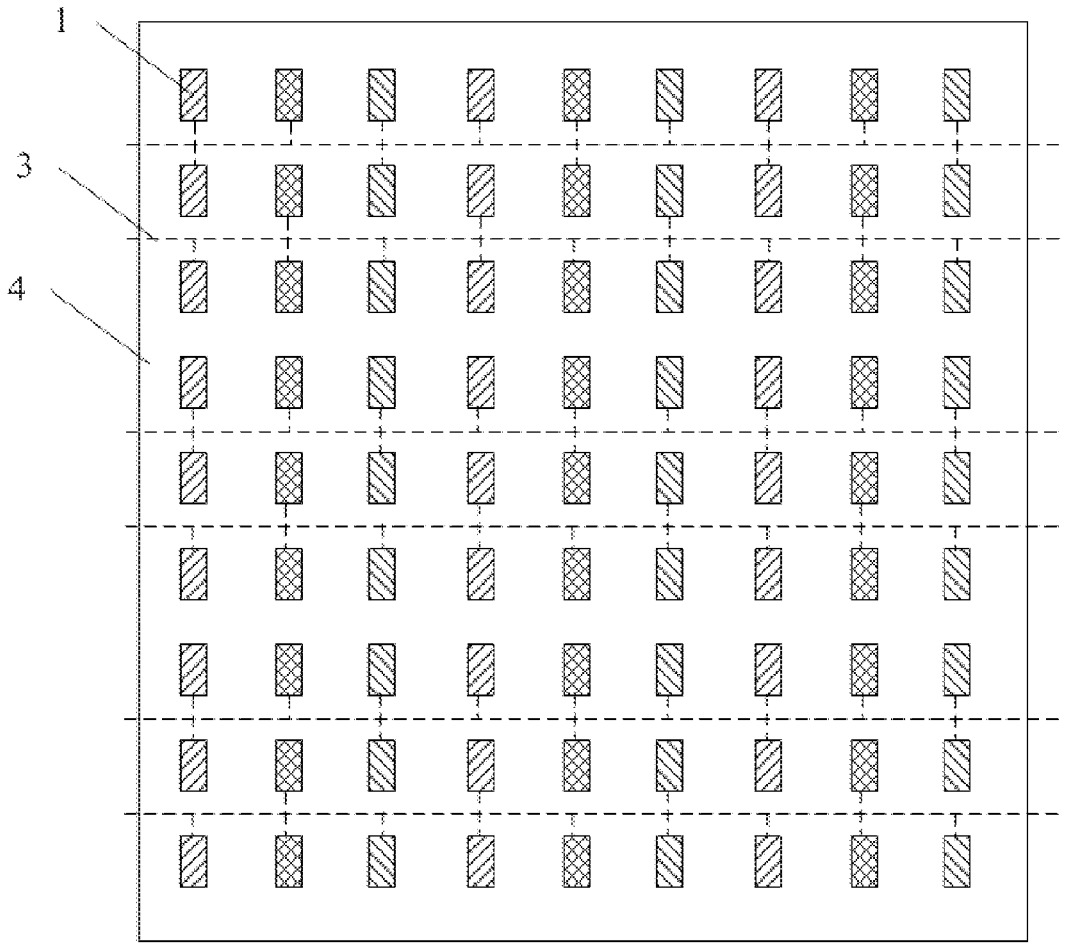
FIG. 5 is a connection schematic diagram of gate lines in a pixel structure of embodiment 2 of the present invention.

An exemplary arrangement of gate lines according to the embodiment is described below with reference to FIGS. 5 and 6. The embodiment differs from embodiment 1 in that the number of gate lines is configured as smaller than L. As shown in FIG. 5, in order to reduce the data processing amount correspondingly, each of the pixel blocks, for example, is provided with two gate lines 3, and each gate line is connected to one or two adjacent rows of sub-pixel units in the same column. Specifically, a first gate line is arranged between the first and the second rows of the pixel units, and a second gate line is arranged between the second and the third rows of the pixel units. Thus, every three rows of pixel units occupy two gate lines, thus reducing the number of gate lines by one third comparing to the prior art, and thus reducing the number of output channels of the gate driver by one third accordingly.

More preferably, the first gate line is connected with the first row of sub-pixel units in all columns and the second row of sub-pixel units in odd columns (or even columns), and the second gate line is connected with the third row of sub-pixel units in all columns and the second row of sub-pixel units in even columns (or odd columns). Thus, through odd-even sorting for the sub-pixel units arranged column by column in the second row of pixel units, and uniformly assigning the sub-pixel units in an odd sequence and the sub-pixel units in an even sequence to the two gate lines, a short circuit fault between two gate lines is effectively avoided, and the loading value on each gate line is substantially equivalent to each other.

Figure 6:
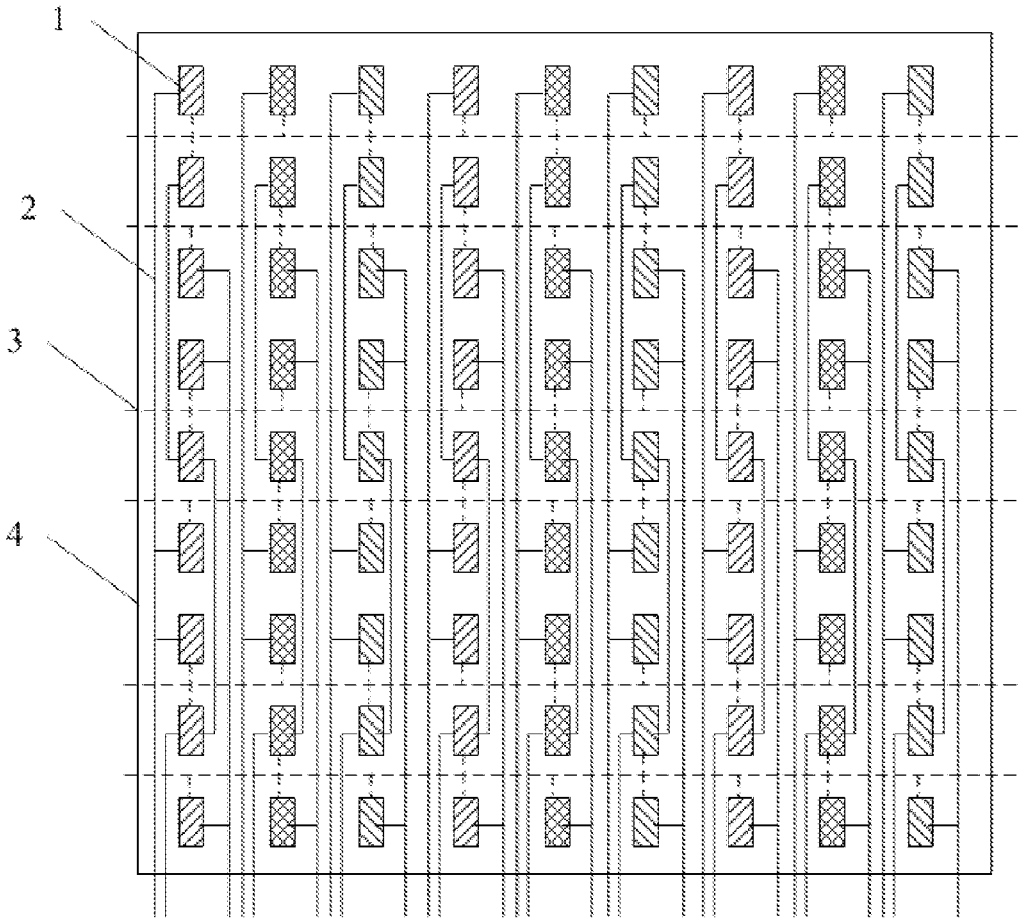
FIG. 6 is a schematic diagram of an example of the pixel structure of embodiment 2 of the present invention.

A connection schematic diagram of the gate lines and data lines in a pixel structure of the embodiment is shown in FIG. 6.

During image displaying, the pixel units receive scanning control signals according to a display sequence of images to be displayed, and image data of images to be displayed corresponding to pixel units in the same pixel block are stored as a group. In the embodiment, scanning signals are sent to pixel units for displaying the corresponding images to be displayed through two gate lines in the corresponding pixel block simultaneously.

In practical application, the gate lines are connected with a timing control unit through a gate line driver. Therefore, the data processing method for the timing control unit and the connecting mode for a data driver with the data lines are correspondingly matched with the pixel structure in the embodiment. Normal sequence and reserve sequence controlling methods are respectively adopted in the timing control unit for timing controls of odd pixel blocks and even pixel blocks. Thus achieving the aim of reducing the row scanning frequency, so that the row scanning time becomes three times of that of the prior art, and sufficient time is obtained for charging the storing capacitor Cs in the pixel unit.

Figure 7:
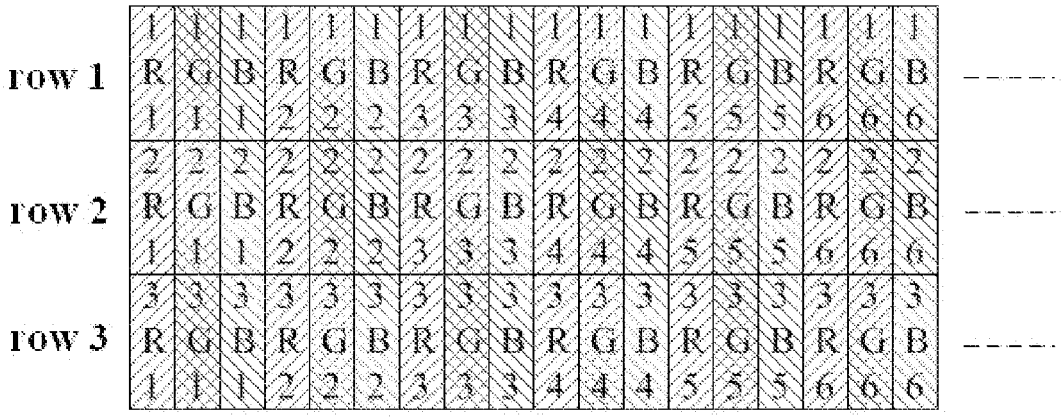
FIG. 7 is a schematic diagram of an input sequence of image data in a pixel structure according to the embodiments of the present invention.
Figure 8:
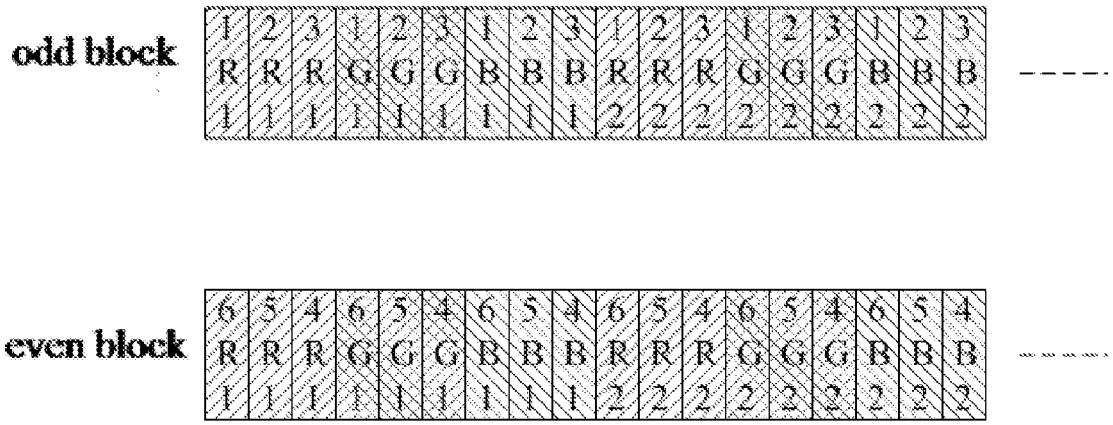
FIG. 8 is a schematic diagram of an output sequence of image data in the pixel structure of embodiment 2 of the present invention.

An input/output sequence of image data of the pixel structure according to the present invention is described with reference to FIGS. 7 and 8, taking the embodiment as an example. FIG. 7 shows a schematic diagram of the input sequence of the image data in the pixel structure according to the embodiment of the present invention. FIG. 8 shows a schematic diagram of an example of the output sequence of the image data in the pixel structure according to the embodiment of the present invention. In FIGS. 7 and 8, each small rectangle corresponds to a sub-pixel unit, and each pixel unit comprises three sub-pixel units which are respectively red (R), green (G) and blue (B). In each small rectangle, a first digit, a letter and a second digit are arranged longitudinally in a sequence from top to bottom. The first digit represents the row number of the sub-pixel unit, the letter represents the color of the sub-pixel unit, and the second digit represents the column number of the sub-pixel unit. For example, 2R3 represents a red sub-pixel unit in the second row and the third column. In the embodiment, the image data input sequence of the timing control unit is the same as that of the prior art, namely successively inputting in sequence; the image data output sequence of the timing control unit is as follows: the row output sequence of sub-pixel units in an odd pixel block is 3i-2, 3i-1 and 3i, and the row output sequence of sub-pixel units in an even pixel block is 3i, 3i-1 and 3i-2, wherein i is an arrangement sequence number of the pixel block from top to bottom.

Specifically, in the timing control unit, caching is performed for image data corresponding to three rows of pixels in the same pixel block. FIG. 7 shows image data input to the timing control unit. After the caching, sorting operation is performed on the image data. FIG. 8 shows image data output from the timing control unit. Finally the sorted image data are sequentially transmitted to the data driver. The image data sorting algorithm herein is correspondingly designed according to the established wiring of the data lines in the display panel, and the smallest unit of the image data is the sub-pixel unit respectively displaying the corresponding image to be displayed, and are arranged sequentially in three rows, so that all sub-pixel units in the same pixel block are scanned (enabled) simultaneously. In the timing control unit, only after the caching of all the three rows of image data is completed, can the image data be transmitted in bulk to the data driver, thus the ultimate display refresh time of the display panel will be some time delayed comparing to the three-row refresh time of the image data input to the timing control unit. In this case, it only needs to adjust the control sequence of an output terminal in the timing control unit accordingly.

Figure 9:
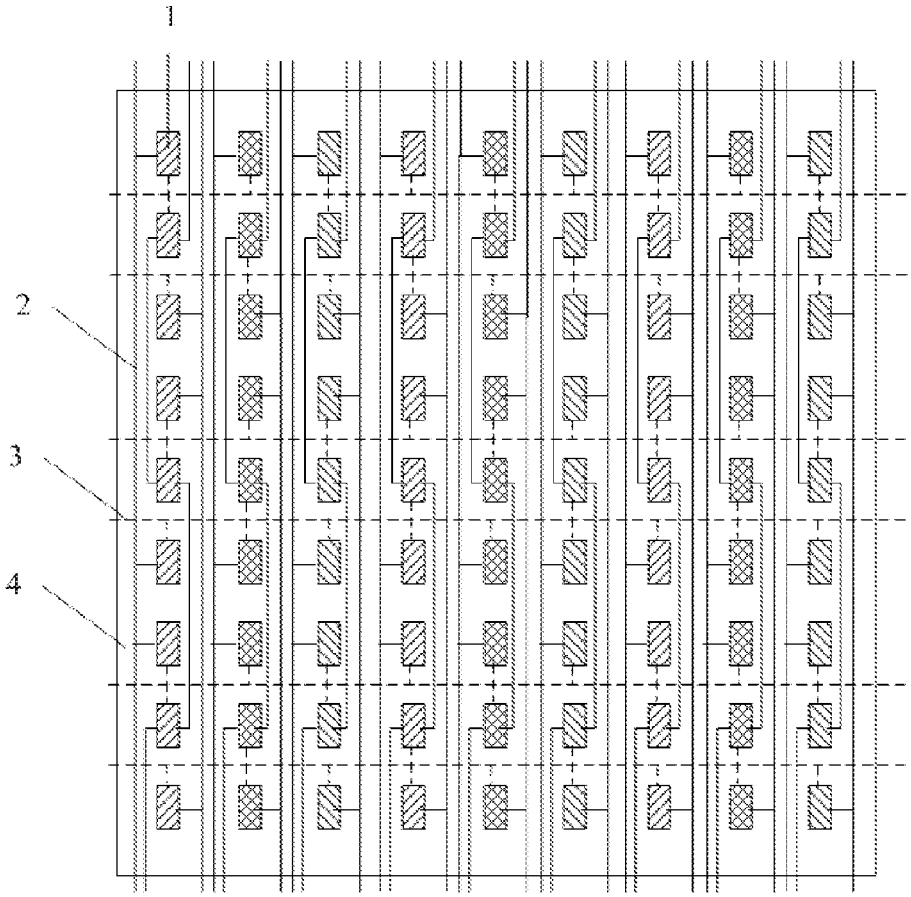
FIG. 9 is a schematic diagram of another example of the pixel structure of embodiment 2 of the present invention.

In the embodiment, as shown in FIG. 6, gate driver chips are respectively connected at the left and right sides of the periphery of the display area 4 of the display panel, that is, the gate lines are driven in a dual-drive mode. The data lines are connected with a source driver, and the data lines are driven in a single-drive mode. Here, it should be appreciated that the gate line drive mode and the data line drive mode can also be single/single-drive modes, single/dual-drive modes and dual/dual-drive modes (as shown in FIG. 9), and whether to adopt the single-drive mode or the dual-drive mode in the applications can be determined according to the product size of the display device, thus detailed description is not made here.

In the embodiments, as each of the pixel units includes three colors, if the resolution is 3840*2160 and the frame refresh rate is 60 Hz, then the number of channels of data lines adopted in the embodiment is 3840*3*3=34560, and the number of gate lines used for driving is 2160÷3*2=1440. Every three data lines are configured to be connected with sub-pixel units in the same column, and every two gate lines are configured to be connected with control terminals of switch tubes of three adjacent rows of sub-pixel units. In the driving process, when scanning is refreshed, three rows of sub-pixel units in the same pixel block are simultaneously enabled (while sub-pixel units in the rest pixel blocks are disabled), and three data lines in the same column of pixel units respectively charge storing capacitors Cs in different rows of sub-pixel units. Then the gate lines enable the three adjacent rows of sub-pixel units in the next pixel block (while sub-pixel units in the rest pixel blocks are disabled), and correspondingly the data lines charge Cs in corresponding sub-pixel units. The process is repeated in this way, thus achieving progressively scanning in unit of three rows for the whole display panel.

In the pixel structure of the embodiment, through increasing the number of data lines to three times of that in the prior art, the number of sub-pixels connected by each data line becomes one third (i.e. 720) of that in the prior art, thereby lowering the RC loading value of the data lines, and particularly lowering the capacitance values of the storing capacitors Cs, so that the problem of RC delay of the data lines can be greatly improved, and meanwhile, the requirement on the driving capability of the driving chip becomes less strict. Moreover, the number of gate lines is two thirds of that in the prior art, and every time when row scanning is performed, every two gate lines turn on the switch tubes in the corresponding rows of pixel units simultaneously, and at the same time the data lines charge the corresponding storing capacitors Cs. As the row scanning frequency becomes one third of that in the prior art, the charging time of the storing capacitors Cs in the pixel units becomes three times (about 20 μs) of that in the prior art, thus guaranteeing the display uniformity and display brightness stability of the display panel, and improving the display quality of the display device. Also, wiring and connecting modes of data lines and gate lines are designed, so that the data lines has no intersection and the gate lines has uniform loading and no shorting.

Embodiment 3

The embodiment differs from embodiment 2 in that each of the pixel units in the embodiment comprises sub-pixel units in four colors, which are red (R), green (G), blue (B) and white (W) respectively.

Figure 10:
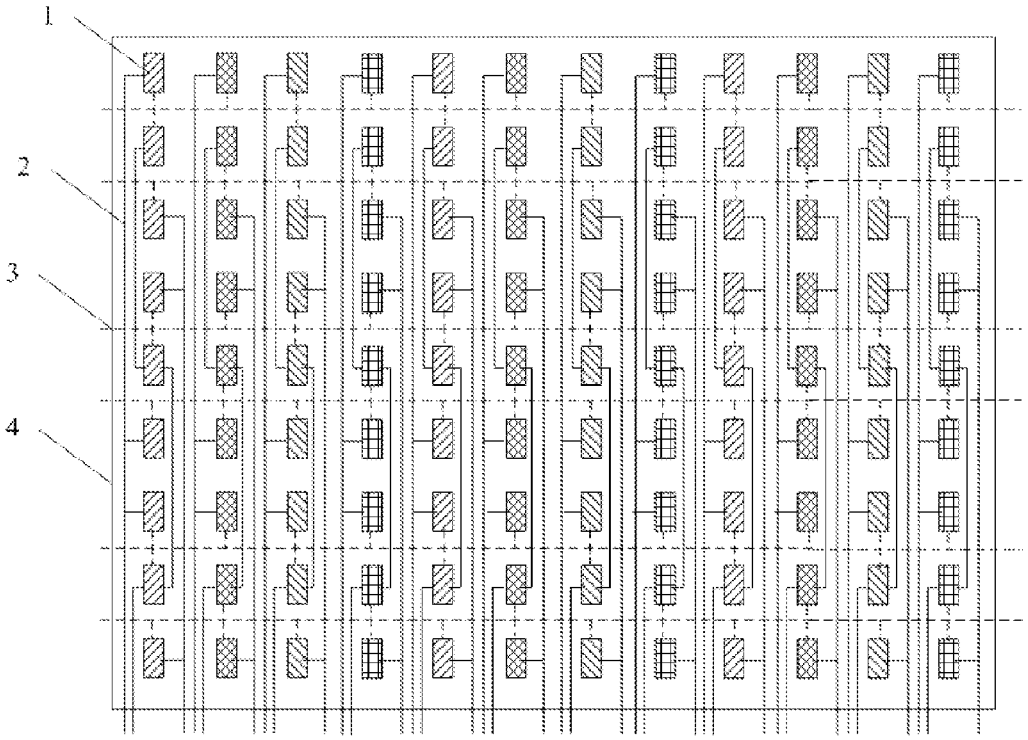
FIG. 10 is a schematic diagram of a pixel structure of embodiment 3 of the present invention.
Figure 11:
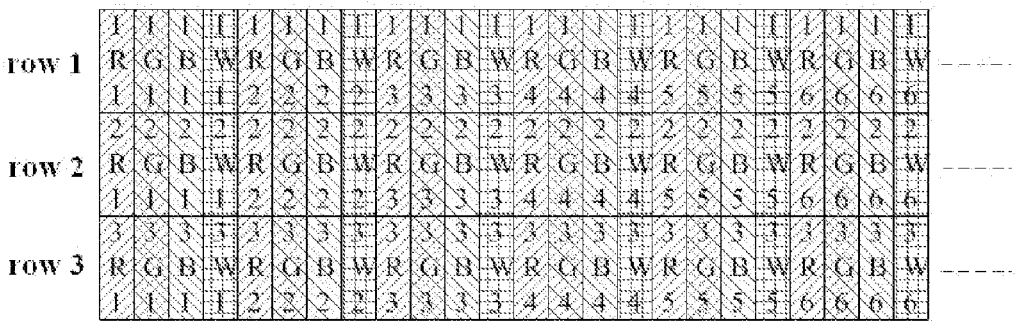
FIG. 11 is a schematic diagram of an input sequence of image data in the pixel structure of embodiment 3 of the present invention.
Figure 12:
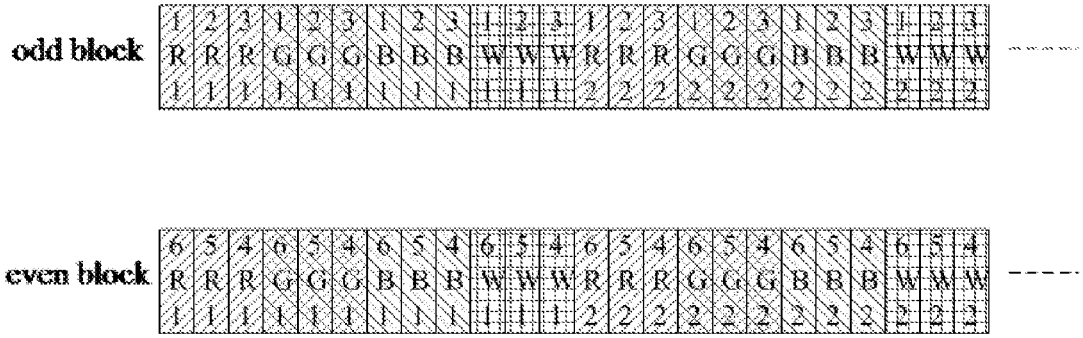
FIG. 12 is a schematic diagram of an output sequence of image data in the pixel structure of embodiment 3 of the present invention.

In the embodiment, the connecting mode of the gate lines and the data lines in the pixel structure and the output sequence of the image data in the timing control unit are the same as those in embodiment 2. As the pixel unit comprises sub-pixel units in four colors, specifically, the connection of the data lines and the gate lines in the pixel structure is as shown in FIG. 10; and the input sequence of the image data in the timing control unit is as shown in FIG. 11, and the output sequence of the image data is as shown in FIG. 12.

In the present invention, in the progressive scanning mode in unit of L rows adopted when scanning is performed in the pixel structure, L rows of sub-pixel units belonging to the same pixel block are enabled simultaneously, and at the same time the image data of the L rows of sub-pixel units are refreshed; and in combination with an image processing method of the corresponding timing control unit for data processing, the image data arrangement requirement of such a pixel structure can be met. As the scanning frequency is reduced to 1/L of that in the prior art, the problem of undercharge of the storing capacitors Cs is greatly improved, and meanwhile, the problem of RC delay of the data lines can be eliminated or alleviated accordingly, thus the display quality of the display device is ensured.

The present invention provides a large-size AM drive-mode pixel structure with advanced display quality, which is particularly suitable to be used in a large-size ultra-high-resolution display device having a pixel structure with an extremely great number of pixel units arranged in a matrix form. The present invention is especially applicable to a thin film transistor liquid crystal display device or an organic light-emitting diode display device.

It can be appreciated that the above embodiments are only exemplary embodiments intended for illustrating the principle of the present invention, but the present invention is not limited thereto. Features adopted in one embodiment can be applied to another embodiment without contradiction or conflict. Various modifications, substitutions and improvements can be made by the person having ordinary skill in the art, without departing from the spirit and gist of the present invention, and those modifications, substitutions and improvements should also be considered to be within the protection scope of the present invention.

What is claimed is:

1. A pixel structure, comprising a plurality of pixel units arranged in a matrix form, and a plurality of gate lines and data lines for providing drive to the plurality of pixel units, wherein the plurality of pixel units are scanned progressively in unit of L rows; the L rows of pixel units being simultaneously scanned among the plurality of pixel units are configured as a pixel block; at least two adjacent rows of pixel units in the L rows of pixel units being used for displaying different images, wherein L≥3 and L is a positive integer; and wherein the plurality of pixel units each comprise a plurality of sub-pixel units having their respective predetermined colors, and each column of the sub-pixel units is provided with L data lines which are connected to the sub-pixel units in a same column in such a manner that one of the L data lines is only connected to one out of the L rows of sub-pixel units, wherein sub-pixel units in odd pixel blocks are respectively connected with the data lines in the order of rows, and sub-pixel units in even pixel blocks are respectively connected with the data lines in the reverse order of rows.

2. The pixel structure according to claim 1, wherein the number of gate lines in each pixel block is (L−1), each gate lines are connected to at least one of the adjacent rows of sub-pixel units in the same column, and each sub-pixel unit has one and only gate line connected therewith.

3. The pixel structure according to claim 2, wherein L=3, and wherein a first gate line is arranged between the first and the second rows of the pixel units, and a second gate line is arranged between the second and the third rows of the pixel units; and wherein the first gate line is connected with the first row of sub-pixel units in all columns and the second row of sub-pixel units in odd columns or even columns, and the second gate line is connected with the third row of sub-pixel units in all columns and the second row of sub-pixel units in the even columns or the odd columns.

4. The pixel structure according to claim 3, wherein the row numbers of sub-pixel units in the odd pixel blocks connected with the respective data lines are 3i-2, 3i-1 and 3i; and the row numbers of sub-pixel units in the even pixel blocks connected with the respective data lines are 3i, 3i-1 and 3i-2, wherein i is an arrangement sequence number of pixel blocks from top to bottom.

5. The pixel structure according to claim 1, wherein the number of gate lines in each pixel block is L, and each sub-pixel unit has one and only gate line connected therewith.

6. The pixel structure according to claim 1, wherein the pixel units receive scanning control signals according to a display sequence of images to be displayed, and image data of images to be displayed corresponding to pixel units in the same pixel block are stored as a group, and scanning signals are sent to pixel units for displaying the corresponding images to be displayed through all the gate lines contained in the corresponding pixel block simultaneously.

7. The pixel structure according to claim 6, wherein the gate lines are driven in a dual-drive mode or a single-drive mode, and the data lines are driven in a dual-drive mode or a single-drive mode.

8. The pixel structure according to claim 7, wherein each of the pixel units comprises sub-pixel units having three or four colors respectively, the three colors being red, green and blue, or the four colors being red, green, blue and white, wherein the sub-pixel units in each pixel unit are arranged in the same color arrangement sequence.

9. A display device, comprising a display structure comprising a plurality of pixel units arranged in a matrix form, and a plurality of gate lines and data lines for providing drive to the plurality of pixel units, wherein the plurality of pixel units are scanned progressively in unit of L rows; the L rows of pixel units being simultaneously scanned among the plurality of pixel units are configured as a pixel block; at least two adjacent rows of pixel units in the L rows of pixel units being used for displaying different images, wherein L≥3 and L is a positive integer; and wherein the plurality of pixel units each comprise a plurality of sub-pixel units having their respective predetermined colors, and each column of the sub-pixel units is provided with L data lines which are connected to the sub-pixel units in a same column in such a manner that one of the L data lines is only connected to one out of the L rows of sub-pixel units, wherein sub-pixel units in odd pixel blocks are respectively connected with the data lines in the order of rows, and sub-pixel units in even pixel blocks are respectively connected with the data lines in the reverse order of rows.

10. The display device according to claim 9, wherein the number of gate lines in each pixel block is (L−1), each gate lines are connected to at least one of the adjacent rows of sub-pixel units in the same column, and each sub-pixel unit has one and only gate line connected therewith.

11. The display device according to claim 10, wherein L=3, and wherein a first gate line is arranged between the first and the second rows of the pixel units, and a second gate line is arranged between the second and the third rows of the pixel units; and wherein the first gate line is connected with the first row of sub-pixel units in all columns and the second row of sub-pixel units in odd columns or even columns, and the second gate line is connected with the third row of sub-pixel units in all columns and the second row of sub-pixel units in the even columns or the odd columns.

12. The display device according to claim 11, wherein the row numbers of sub-pixel units in the odd pixel blocks connected with the respective data lines are 3i-2, 3i-1 and 3i; and the row numbers of sub-pixel units in the even pixel blocks connected with the respective data lines are 3i, 3i-1 and 3i-2, wherein i is an arrangement sequence number of pixel blocks from top to bottom.

13. The display device according to claim 9, wherein the number of gate lines in each pixel block is L, and each sub-pixel unit has one and only gate line connected therewith.

14. The display device according to claim 9, wherein the pixel units receive scanning control signals according to a display sequence of images to be displayed, and image data of images to be displayed corresponding to pixel units in the same pixel block are stored as a group, and scanning signals are sent to pixel units for displaying the corresponding images to be displayed through all the gate lines contained in the corresponding pixel block simultaneously.

15. The display device according to claim 14, wherein the gate lines are driven in a dual-drive mode or a single-drive mode, and the data lines are driven in a dual-drive mode or a single-drive mode.

16. The display device according to claim 9, wherein each of the pixel unit comprises sub-pixel units having three or four colors respectively, the three colors being red, green and blue, or the four colors being red, green, blue and white, wherein the sub-pixel units in each pixel unit are arranged in the same color arrangement sequence.

* * * * *